US006570604B2

(12) United States Patent
Able et al.

(10) Patent No.: US 6,570,604 B2
(45) Date of Patent: May 27, 2003

(54) MODE DEPENDENT TIME TO BEGIN PRINTING

(75) Inventors: Douglas Anthony Able, Shelbyville, KY (US); Kevin Dean Schoedinger, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/835,947

(22) Filed: Apr. 16, 2001

(65) Prior Publication Data

US 2002/0149669 A1 Oct. 17, 2002

(51) Int. Cl.[7] ..... B41J 2/435
(52) U.S. Cl. ..... 347/262; 347/264
(58) Field of Search ..... 347/235, 234, 347/248, 262, 264, 16, 139; 399/33

(56) References Cited

U.S. PATENT DOCUMENTS 4,589,764 A 5/1986 Tadokoro et al. ..... 347/132
5,206,694 A * 4/1993 Ohira et al. ..... 399/33
5,274,461 A 12/1993 Mitsuhashi ..... 358/296
5,280,328 A 1/1994 Goto et al. ..... 399/70
5,448,267 A 9/1995 Sugiura et al. ..... 347/260
5,500,667 A * 3/1996 Schiwiebert et al. ..... 347/102
5,550,573 A 8/1996 Serizawa et al. ..... 347/246
5,581,281 A 12/1996 Fuse ..... 347/14
5,659,342 A 8/1997 Lund et al. ..... 347/35
5,751,304 A 5/1998 Hirabayashi et al. ..... 347/17
5,877,798 A 3/1999 Clarke et al. ..... 347/250
5,883,659 A 3/1999 Serizawa et al. ..... 347/260
6,072,585 A 6/2000 Dutton et al. ..... 358/1.12

* cited by examiner

*Primary Examiner*—Hai Pham
(74) *Attorney, Agent, or Firm*—John A. Brady

(57) ABSTRACT

Before warm-up of a printer, sheets are initially fed for printing based on a normal assumed lock time for rotation of polygonal mirror (116) of a laser printhead (100). After an initial printing when in a mode in which the printer is warmed, such as a standby mode, sheets are fed for printing based on a lock time shorter than the normal lock time. When a lock time failure is observed when using the shorter lock time, use of the longer lock time is resumed. Time to begin printing is improved by the use of the shorter lock time.

2 Claims, 5 Drawing Sheets

MODE DEPENDENT TIME TO BEGIN PRINTING

TECHNICAL FIELD

This invention relates to printers that require some tangible time between a nonprinting status and actual marking on paper or other sheets. More specifically, this invention relates to improving the time to begin printing of the first sheet of a job, depending on the mode of the printer immediately before such printing.

BACKGROUND OF THE INVENTION

In laser printers of today, time to first print is often limited to the printhead lock time, which has been specified as a single time for all printing modes. Different printing modes in this context include off as one mode and on but inactive (standby), as another mode. Printhead lock is simply the stable operation of the laser printhead at a predetermined speed, and printhead lock time is the time from start from inactive or partially inactive to printhead lock.

The printhead lock time for all printing modes necessarily assumes operating conditions at minimum voltage and minimum temperature over the life of the printer. This results in a specified lock time that is significantly longer than typical operation. However, if this lock time were reduced for all printing, the number of printing failures would increase.

DISCLOSURE OF THE INVENTION

In accordance with this invention, the lock time is left at a conservative, longer amount for one mode of the printer and is set at a shorter time for another mode of the printer. Additionally, when the lock time is the shorter lock time, recognition of a print failure or potential print failure related to the shorter time is responded to by lengthening the lock time for all subsequent printing.

In the embodiment disclosed, the lock time is the assumed time from slow or off of the polygon mirror of a laser printer to stable rotation of the polygon mirror. The mode from which the longer amount is employed is printing after the printer full off. The longer time is selected because at full off the printer may be unusually cold or otherwise not stabilized to its environment. The other mode is printing from standby or another power-on state. At standby, the motors and heaters of the printer typically have operated enough in the recent past to have stabilized the printer to its normal environment and the fuser is still being partially warmed to a level permitting quick printing. The motor rotating the polygon mirror is typically off at standby. The paper or other sheet to be printed is picked based on time from initiation of the print cycle. If the sheet reaches the print area at the expected lock time but the printhead has not locked, failure occurs, and all subsequent lock times are adjusted to the longer lock time.

BRIEF DESCRIPTION OF THE DRAWINGS

The details of this invention will be described in connection with the accompanying drawings, in which.

DESCRIPTION OF THE EMBODIMENTS

Printing System

Figure 1:
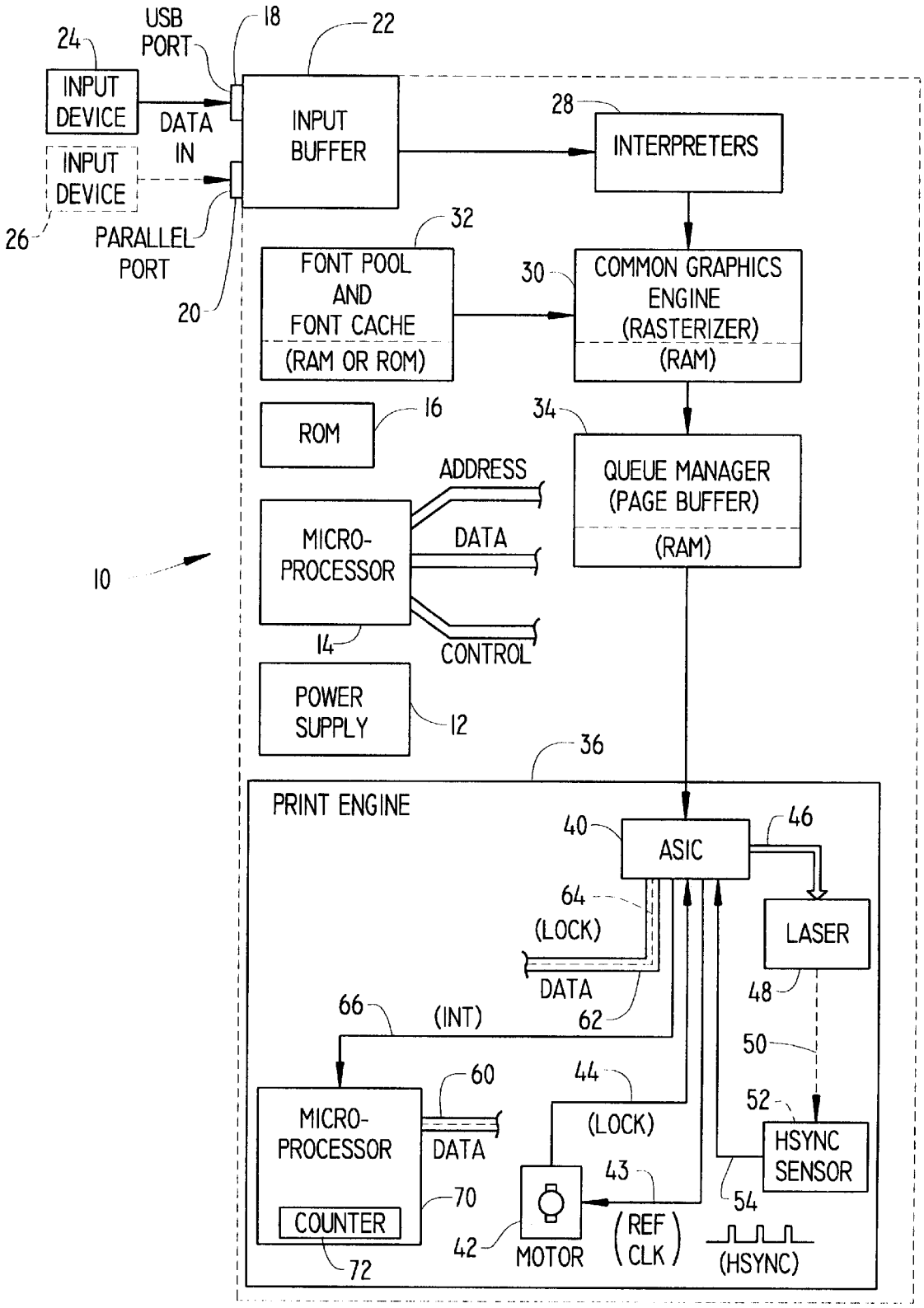
FIG. 1 is a hardware block diagram of the major components used in a laser printer which may incorporate this invention.

Referring now to the drawings, FIG. 1 shows a hardware block diagram of a laser printer generally designated by the reference numeral 10. Laser printer 10 will preferably contain certain relatively standard components, such as a DC power supply 12 which may have multiple output of different voltage levels, a microprocessor 14 having address lines, data lines and control and/or interrupt lines. Read Only Memory (ROM) 16, and Random Access Memory (RAM), which is divided into several portions for performing several different functions.

Laser printer 10 will typically contain at least one serial input, parallel input or USB port, or in many cases two types of input ports, as designated by reference numeral 18 for the USB port and the reference numeral 20 for the parallel port. Each of these ports 18 and 20 would be connected to a corresponding input buffer, generally designated by the reference numeral 22 on FIG. 1. USB port 18 would typically be connected to a USB output port of a personal computer or a workstation that would contain a software program such as a work processor or a graphics package or computer aided drawing package. Similarly, parallel port 20 could also be connected to a parallel output port of the same type of personal computer or workstation containing the same type of programs, only the data cable would have several parallel lines. Such input devices are designated, respectively, by the reference numerals 24 and 26 on FIG. 1.

Once the text or graphical data has been received by input buffer 22, it is commonly communicated to one or more interpreters designated by the reference numeral 28. A common interpreter is PostScript™, which is an industry standard used by most laser printers. After being interpreted, the input data is typically sent to a common graphics engine to be rasterized, which typically occurs in a portion of RAM designated by the reference numeral 30 on FIG. 1. To speed up the process of rasterization, a font pool and possibly also a font cache is stored, respectively, in ROM or RAM within most laser printers, and these font memories are designated by the reference numeral 32 on FIG. 1. Such font pools and caches supply bitmap patterns for common alphanumeric characters so that the common graphics engine 30 can easily translate each such character into a bitmap using a minimal elapsed time.

Once the data has been rasterized, it is directed into a queue manager or page buffer, which is a portion of RAM, designated by the reference numeral 34. In a typical laser printer, an entire page of rasterized data is stored in the queue manager during the time interval that it takes to physically print the hard copy for that page. The data within the queue manager 34 is communicated in real time to a print engine designated by the reference numeral 36. Print engine 36 includes the laser light source within the printhead, and its output results in physical inking onto a piece of paper, which is the final print output from laser printer 10.

It will be understood that the address, data and control lines are typically grouped in buses, and which are physically communicated in parallel (sometimes also multiplexed) electrically conductive pathways around the various electronic components within laser printer 10. For example, the address and data buses are typically sent to all ROM and RAM integrated circuits, and the control lines or interrupt lines are typically directed to all input or output integrated circuits that act as buffers.

Print engine 36 contains as ASIC (Application Specific Integrated Circuit) 40, which acts as a controller and data manipulating device for the various hardware components within the print engine. The bitmap print data arriving from queue manager 34 is received by ASIC 40, and at the proper moments is sent via signal lines 46 to the laser, which is designated by the reference numeral 48.

ASIC 40 controls the various motor drives within the print engine 36, and also receives status signals from the various hardware components of the print engine. A motor 42 is used to drive the faceted mirror (see the polygonal mirror 116 on FIG. 2), and when motor 42 ramps up to a rotational speed (i.e., its "lock" speed) that is dictated or measured by the frequency of a reference signal ("REF CLK") at a signal line 43, a "Lock" signal will be enabled on a signal line 44 that is transmitted to ASIC 40.

The lock signal may be dictated or controlled by various alternatives. Where the lock speed is to be different for different applications by the same printer 10, reference frequencies are supplied to track motor 42 supporting different lock speed at different reference frequencies. Where only a single lock speed is to be employed by motor 42, the HSYNC signal (discussed below) may be supplied to motor 42 with a predetermined comparison to motor speed defining lock. Virtually any practical means to determine when a motor is at a stabilized, predetermined speed are alternatives and many such means are well within the state of the art or may be developed in the future.

During conventional operation, once ASIC 40 receives the lock signal from motor 42, it transmits a corresponding lock signal (as part of a byte of a digital signal) along one of the data lines 64 of the data bus 62 that communicates with ASIC 40. Data bus 62 is either the same as the data bus 60 that communicates with microprocessor 70, or a portion thereof. When this lock status signal is received by microprocessor 70, microprocessor 70 initiates action of printer 1 leading to printing by printer 1 in normal course.

HSYNC Signal Generation

The HSYNC signal is received from an optical sensor designated by the index number 52 and called the HSYNC sensor. The laser light source 110 (see FIG. 2) places a spot of light on the rotating polygonal mirror 116, which then redirects the laser light so that it ultimately sweeps or "scans" across a "writing line" on a photoconductive drum, thereby creating a raster line of either black or while print elements (also known as "pels"). As the laser light scans to create this raster line, the laser light momentarily sweeps across HSYNC sensor 52 at the beginning of each sweep or "scan" across one of the facets of polygonal mirror 116. The laser light travels from laser 110 to the HSYNC sensor 52 along a light path, designated diagrammatically by the reference numeral 50 on FIG. 1. This produces an electrical pulse output signal from HSYNC sensor 52, which is communicated to ASIC 40 by a signal line 54. HSYNC signal 54 could be immediately directed to microprocessor 70, however, it is preferred to use a "divide-by-n" counter (not shown) within ASIC 40, to reduce the frequency of pulses leaving ASIC 40 along a control line 66, before arriving at microprocessor 70. In one exemplary embodiment, the value for "n" was set to eight (8) thereby providing an output pulse from ASIC 40 upon every eighth input pulse received along signal line 54.

As related above, a "capture" counter, designated by the reference numeral 72, is allowed to operate within microprocessor 70 in a free running mode, and its value is saved every time a signal is received over the control line 66. By use of the different values of the count taken at each interrupt, microprocessor 70 can determine the frequency of HSYNC signal.

Figure 2:
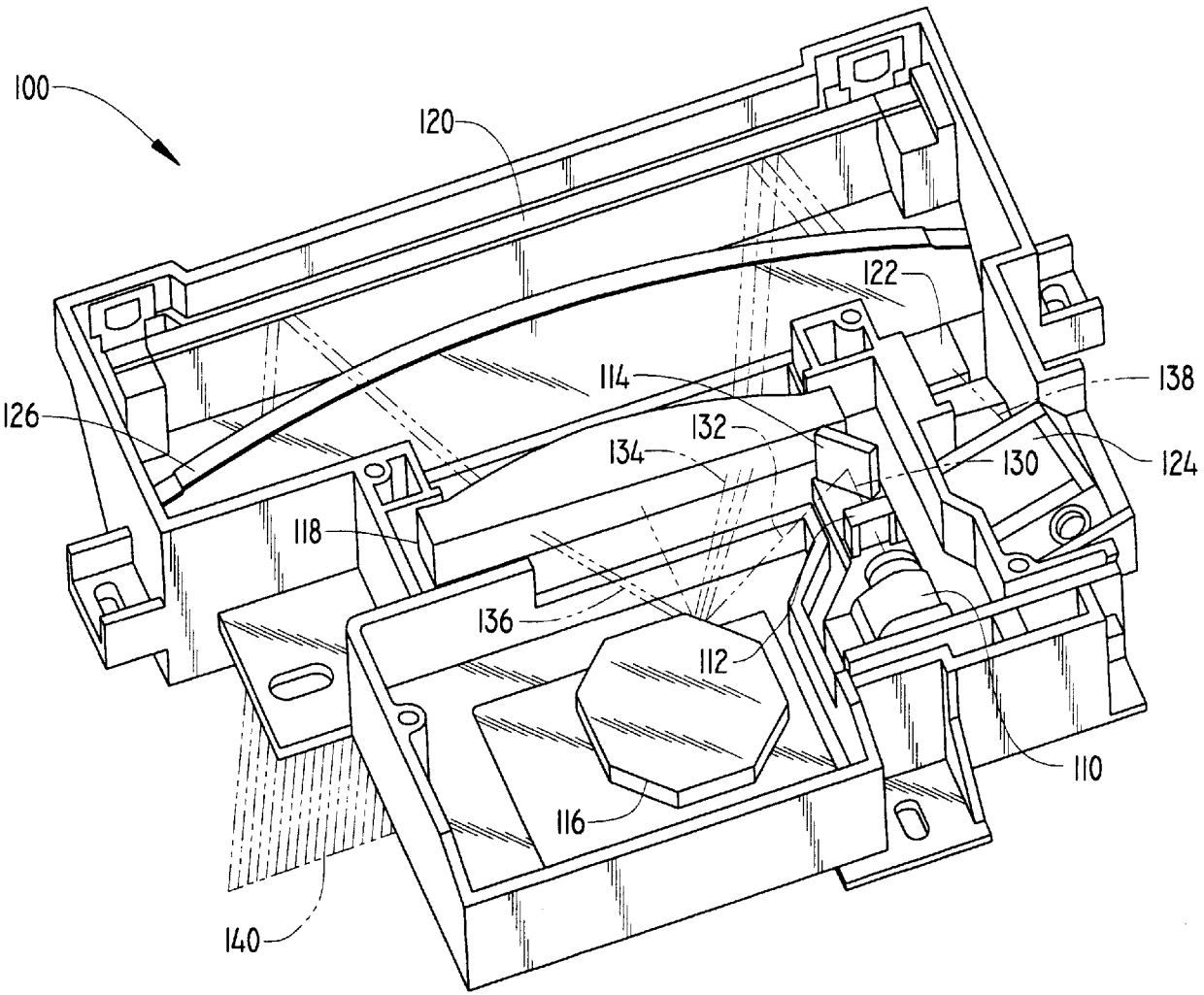
FIG. 2 is a perspective view in partial cut-away of a laser printhead particularly showing the details of the light pathways from the laser to the HSYNC sensor.

FIG. 2 provides a perspective partially cut-away view of some of the major components of a printhead 100 of laser printer 10. Starting at the laser light source 110, the light travels through a lens 112 along a pathway 130 and is redirected by a "pre-scan" mirror 114. The redirected light path, designated by a reference numeral 132, puts a spot of light on an eight-sided polygonal mirror 116. Some of the other major optical components within laser printer 10 include a lens 118, a "post-scan" fold mirror 120, a "start of scan" mirror 122, an optical sensor mounted to an HSYNC sensor card 124, and another lens 126 that directs the light into a "writing line" designated by the reference 140.

After the laser light leaves the laser source 110, it is focused by lens 112 into a narrow beam that follows light path 130, before arriving at the pre-scan mirror 114. This mirror redirects the light into a path 132 which strikes a spot on the polygonal mirror 116. As mirror 116 rotates (due to motor 42), the reflected laser light is swept by one of the facets of mirror 116 from a starting position for each raster scan at the reference numeral 134, to an ending position of the raster scan at the reference numeral 136. The ultimate goal is to sweep the laser light across a photoconductive drum (not shown), thereby creating a series of parallel light paths as a "writing line" and designated by reference numeral 140. To achieve this writing line 140, the swept laser light is directed through lens 118 and reflected in a downward direction (preferably by 90 degrees) by the fold mirror 120. The final lens 126 is used to provide the final aiming of the swept light that creates writing line 140.

A portion of the swept light that creates each raster scan is aimed by the polygonal mirror 116, lens 118, fold mirror 120, and a "start of scan" mirror 122 to create a light signal that follows the path designated by the reference numeral 138. Light that ultimately travels along path 138 will be directed to impact an optical sensor on the HSYNC sensor card 124, and the optical sensor is equivalent to the HSYNC sensor 52, seen on FIG. 1. In FIG. 2 since there are eight (8) facets or sides to polygonal mirror 116, each one-eighth rotation of mirror 116 will create an entire swept raster scan of laser light that ultimately becomes the writing line 140. For a small instant at the start of each of these scans, there will be a light beam that travels along path 138 to impact the HSYNC sensor 52 on the HSYNC sensor card 124. This HSYNC signal will be created during each scan at all times during normal operation of laser printer 10 when the printhead is running, even during scans in which there are no pels to be printed on the photoconductive drum. Laser source 110 is controlled such that it will produce no light at all for raster lines that are to be left blank on the final printed page, except for a brief moment at the end of each scan, so that the HSYNC signal will be produced at the beginning of each successive scan.

Operation in Two Modes

After turn-on of power and stabilization of printer 10, microprocessor 70 promptly records this occurrence, typically by reversing a bit in a volatile memory. (A memory which is volatile will inherently lose this data at turnoff. Alternatively, microprocessor 70 can be programmed to reverse that memory bit during its power down sequence.)

For purposes of description, mode 1 is designated as the status of printer 10 from turning power on from power off through stabilization of printer 10. Stabilization with respect to mode 1 occurs at the completion of initial activities such as self check and warm up of the printer 10. Mode 2 is the status of initiating printing by printer 10 prior to turn off of printer 10 and after mode 1. In mode 2 printer elements continue to be warmed, at least by the power supply being active. This invention employs novel printhead lock time assumptions based on the printer being in mode 2.

A longer lock time is provided for when in mode 1. This addresses the potential need to have a longer lock time when the temperature of printer 10 might be below room temperature, because, for example, it has been in a cooler environment. Similarly, when the printer 10 has been off some small surface bonding may slow start up.

Once the printer has completed the warm-up during mode 1, the temperature of motor 42 is then close to room ambient condition and remains at least at this ambient condition by convection heating within printer 10 due to other components, such as the power supply.

Figure 3A:
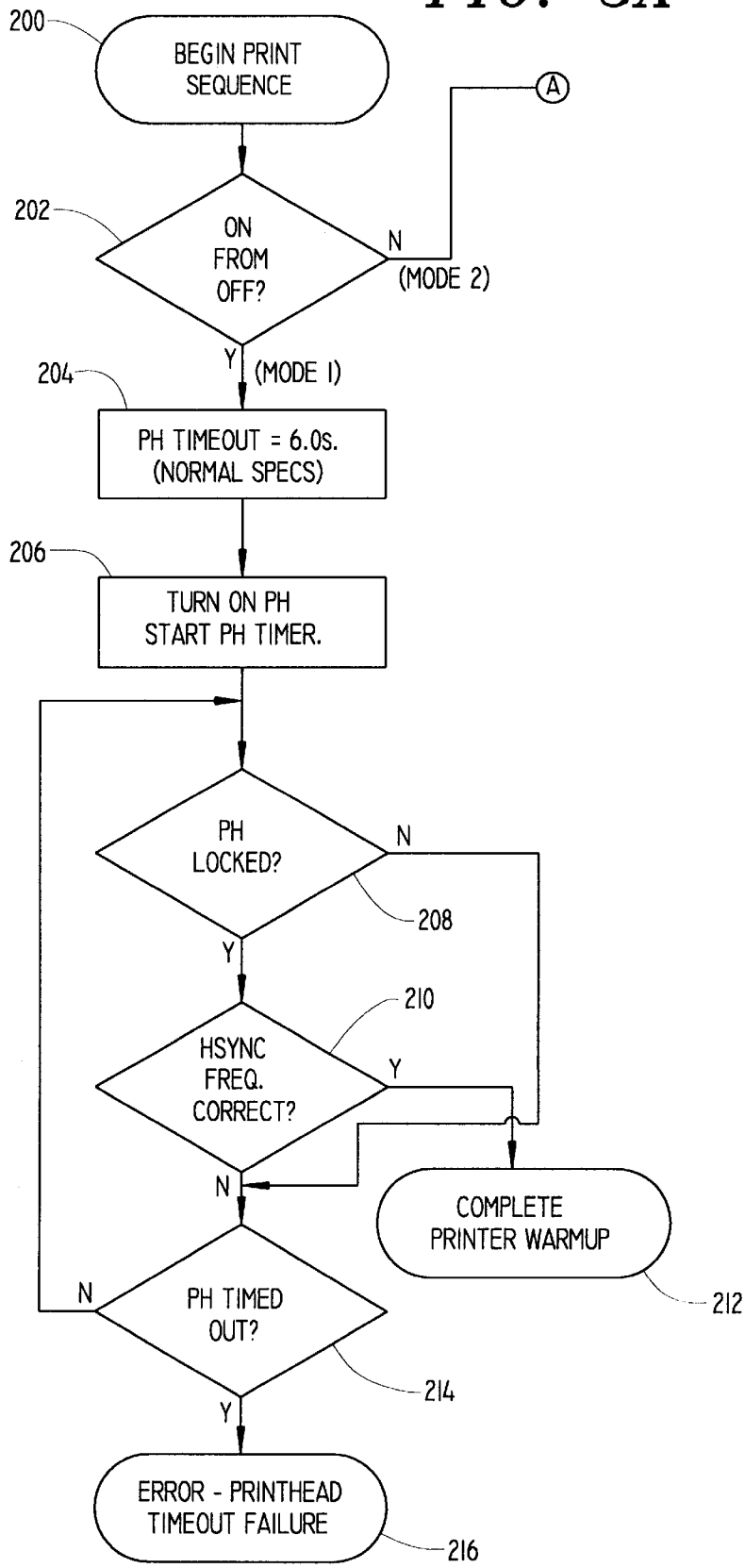
FIGS. 3A, 3B and 3C are a flow diagram illustrating the operation of this invention.
Figure 3B:
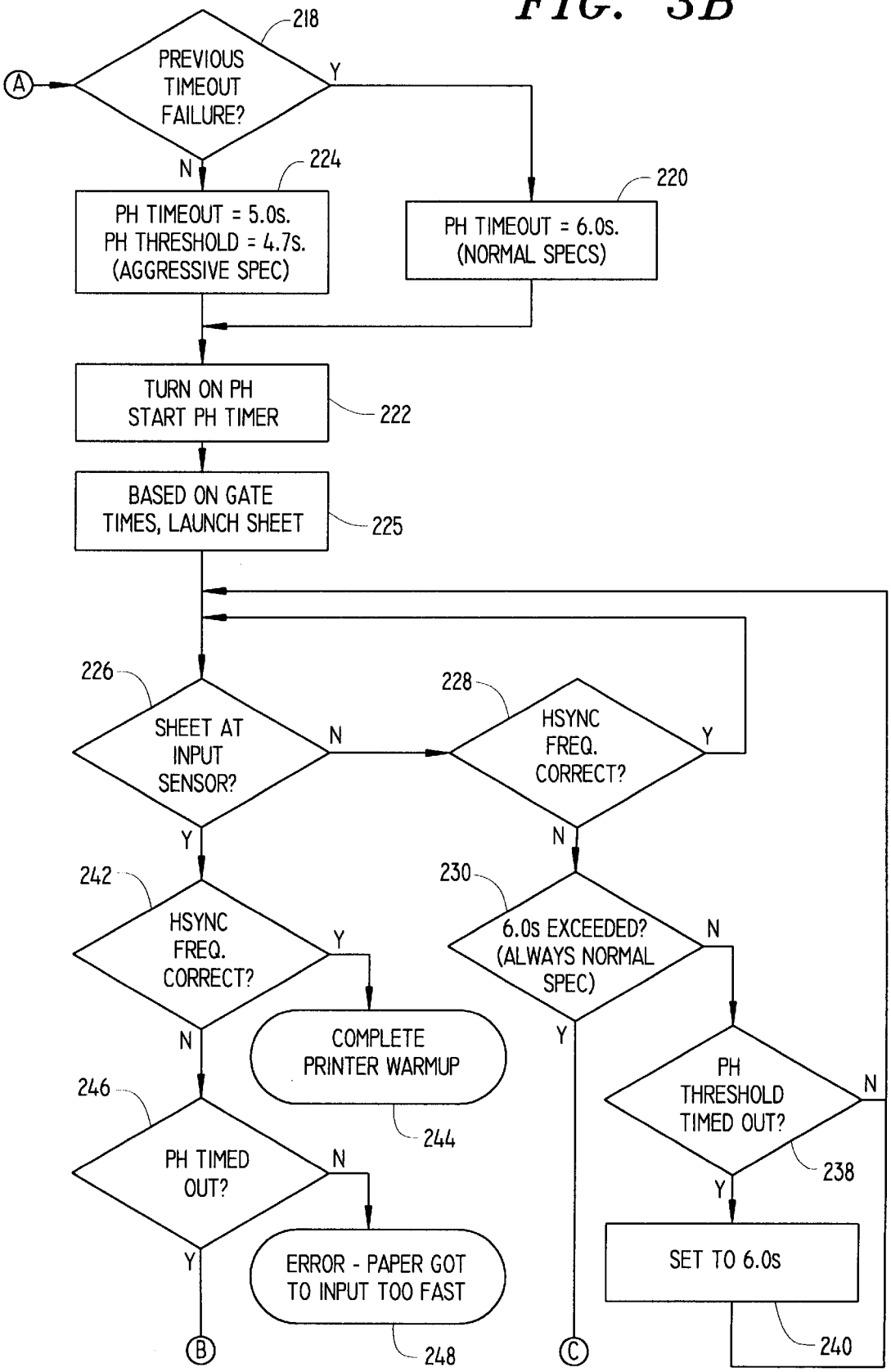
Figure 3C:
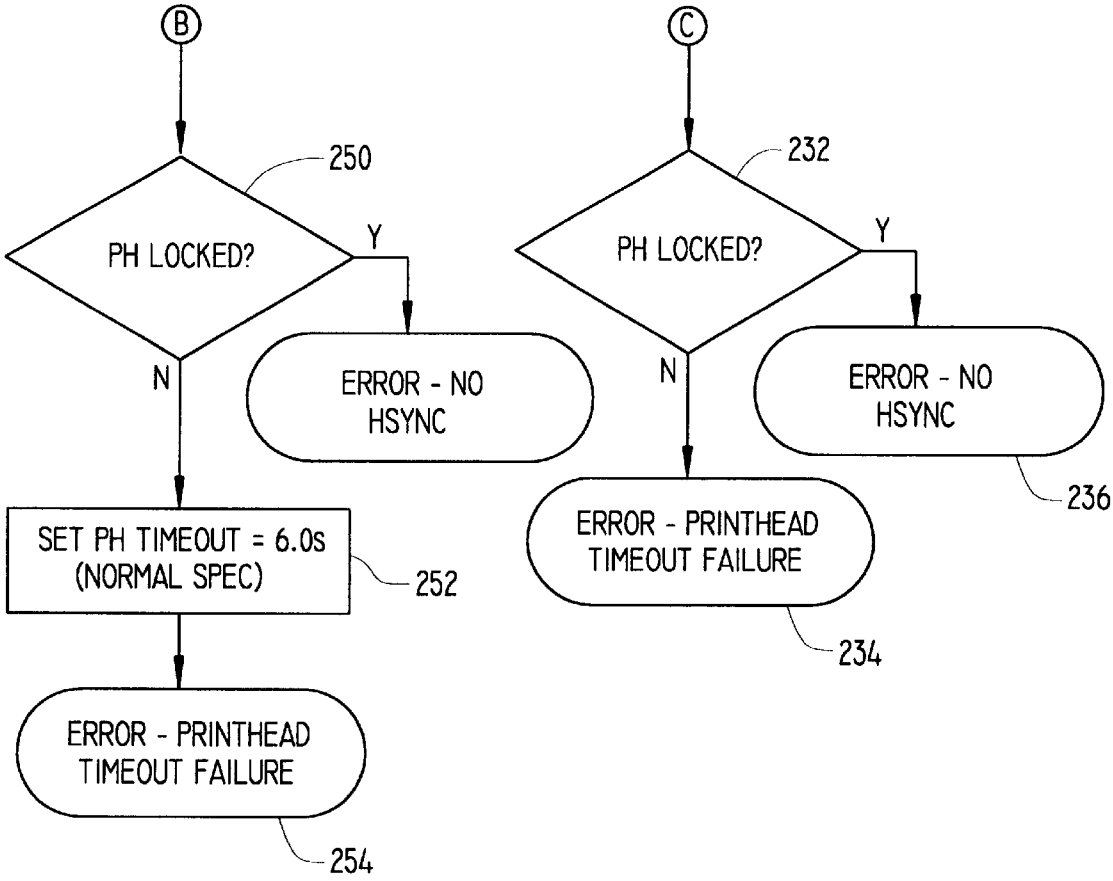

FIG. 3 illustrates the functioning of printer 10 under program control of microprocessor 70 (or equivalent control by an ASIC) employing different lock times. The beginning action 200 is the initiation of the printing of a page or initiation of power on from power off with or without initiation of printing of a page.

This calls decision 202, which determines whether action 200 was power on from previous power off. When decision 202 is yes (Y), the printer is in Mode 1 and 6 seconds, the normal timeout specification for lock time, is set in action 204 as the printhead (PH) timeout. In action 206, the printhead is promptly turned on and the timer is turned on simultaneously.

Subsequently, the printhead is observed for being locked in decision 208. Where yes, decision 210 is called which determines if the HSYNC frequency (freq.) is correct. Where yes, warm up is completed in action. This typically involves an appreciable period to warm a fixing heater. When adequate temperature at the fixing heater is sensed, a sheet is launched if printing of a sheet is pending.

In both mode 1 and mode 2, correct HSYNC frequency is deemed to assure printhead lock, as HSYNC is produced by printhead rotation.

When decision 208 or 210 is no (N), the decision 214 determines whether the 6-second timeout for achieving printhead lock has occurred. If no, action 208 is initiated again. If yes, a printhead timeout failure is posted in action 216.

A subsequent print sequence from action 200 results in decision 202 being no. When decision 202 is no, the printer is in mode 2 and decision 218 is called up to determine if there has been a previous timeout failure.

When decision 218 is yes, action 220 sets timeout at the normal 6 seconds, and calls action 222 which turns on the printhead and the printhead timer.

When decision 218 is no, a faster printhead lock time is assumed by action 224 setting a printhead timeout of 5 seconds, and a second period, termed printhead threshold, of 4.7 seconds. Decision 218 also calls action 222.

A sheet to be printed is launched by action 225 at a time requiring the assumed printhead lock within 5 seconds. Accordingly, printing of the first sheet in mode 2 with no previous timeout failure is one second faster than the normal specification. (Immediately subsequent sheets are not constrained by printhead lock as the printhead is not turned off between those sheets.)

Then decision 226 begins periodic observation for arrival of the sheet at a predetermined location (which may be observed by a simple switch moved by the sheet, not shown, or virtually any other physical sensor). When decision 226 is no, decision 228 examines whether the HSYNC frequency is correct. When decision 228 is yes, decision 226 is examined again.

When decision 228 is no, decision 230 examines the printhead time for having exceeded 6 seconds. If yes, decision 232 examines the lock status to determine if the printhead is locked. If no, a printhead timeout failure is posted in action 234. If decision 232 is yes, a no HYSNC error is posted in action 236.

When decision 230 does not find the 6 seconds exceeded, decision 238 is called to determine if the 4.7 second threshold has timed out. If no, decision 226 can act with the 5-second timeout period, and decision 239 calls decision 226. If yes, decision 238 calls action 240, which revises the threshold period to 6 seconds and calls decision 226.

When a sheet is found at the sensor by decision 226, decision 242 is called to determine if the HSYNC frequency is correct. If yes, normal printing is conducted by action 244.

If decision 242 is no, decision 246 determines if the 5-second or 6-second printhead timeout has occurred (when set by action 220 or 224). If no, an error is posted in action 248 indicating the paper arrived too fast. If yes, decision 250 examines the lock status to determine if the printhead is locked.

If decision 250 is no, the printhead timeout is set to 6 seconds in action 252 and a printhead timeout failure is posted in action 254. If decision 250 is yes, a no HYSNC error is posted in action 236.

Actions 216, 234 and 254 each define failure and action 240 defines a detected potential print failure, are the actions to which decision 218 responds to find yes. The immediate lengthening of timing after failure of actions 240 and 252 are for retries separate from inputs from action 200. The setting of action 218 to yes is stored in permanent memory to minimize future failures.

As much of the system control with respect to this invention is by software or firmware, implementation may take a wide variety of forms, provided that a cold mode and an at-least-partially-warmed mode are recognized. In the foregoing embodiment a power saving mode in which a fuser is not partially warmed is treated as a mode 2. However, unless the fuser heats very quickly, sensing of a predetermined heater temperature delays first print. Belt fusers heat so quickly that such delay would not be experienced with a belt fuser. A standby mode is one in which the fuser is partially heated and the print time is not limited by the fuser and therefore time to first print is controlled by this invention.

What is claimed is:

1. A method of imaging employing an imaging device having characteristics of being turned on from off and having a motor-driven element operating in at least a partially inactive state after turn on and having a continuing warmed condition after turn on comprising the steps of:

when said imaging device is turned on from off, feeding sheets for imaging by said imaging device after a first predetermined period from initiation of an imaging operation and when said imaging device has been continuously turned on and is in said warmed condition, feeding sheets for imaging by said imaging device after a second predetermined period from initiation of an imaging operation, said second predetermined period being shorter than said first predetermined period and resuming said feeding of sheets after said first predetermined period regardless of continuing warming of said imaging device after failure of said motor-driven element to reach a predetermined status within said second predetermined period.

2. The method as in claim 1 in which said element is a polygon mirror of a laser printer.

* * * * *